US009046814B2

(12) United States Patent
Hirukawa et al.

(10) Patent No.: US 9,046,814 B2
(45) Date of Patent: Jun. 2, 2015

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Kuniaki Hirukawa, Susono (JP); Hideki Maeshima, Mishima (JP); Shuichi Gofuku, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 13/892,611

(22) Filed: May 13, 2013

(65) Prior Publication Data

US 2013/0308988 A1 Nov. 21, 2013

(30) Foreign Application Priority Data

May 15, 2012 (JP) ..... 2012-111885

(51) Int. Cl.
*G03G 15/08* (2006.01)
*G03G 21/18* (2006.01)

(52) U.S. Cl.
CPC ..... *G03G 15/0808* (2013.01); *G03G 15/0812* (2013.01); *G03G 21/1814* (2013.01); *G03G 15/0877* (2013.01)

(58) Field of Classification Search
CPC ..... G03G 15/0806; G03G 15/0813; G03G 15/0832
USPC ..... 399/258, 262, 263, 281
See application file for complete search history.

(56) References Cited

U.S. PATENT DOCUMENTS

2007/0189814 A1* 8/2007 Gayne et al. ..... 399/284
2008/0193171 A1* 8/2008 Adachi et al. ..... 399/284

FOREIGN PATENT DOCUMENTS

JP 2011-22394 A 2/2011
JP 2011-39554 A 2/2011

* cited by examiner

*Primary Examiner* — Gregory H Curran
(74) *Attorney, Agent, or Firm* — Canon USA Inc IP Division

(57) ABSTRACT

A developing device includes a developing chamber, a developer containing chamber located on the lower side of the developing chamber, a partition wall configured to separate the developing chamber and the developer containing chamber, an opening configured to allow the developing chamber and the developer containing chamber to communicate with each other, disposed on the partition wall, a developer conveyance member configured to convey developer from the developer containing chamber to the developing chamber by causing the developer to pass through the opening, disposed on the developer containing chamber. In the developing device, a convex portion which protrudes to the developing chamber side is disposed on the partition wall.

26 Claims, 15 Drawing Sheets

DEVELOPING DEVICE, PROCESS CARTRIDGE, AND IMAGE FORMING APPARATUS

BACKGROUND OF THE INVENTION

1. Field of the Invention

The present invention relates to a developing device used for an image forming apparatus, a process cartridge detachable to an apparatus main body of the image forming apparatus, and the image forming apparatus for forming an image on a recording medium.

Image forming apparatuses described below exemplify image forming apparatuses for forming images on recording media. Therefore, an electro-photographic copying machine, an electro-photographic printer (such as a laser beam printer, a light-emitting diode (LED) printer), and a facsimile apparatus, which employ an electro-photographic image forming method are included as examples of the image forming apparatuses.

The developing device is a device for developing an electrostatic latent image formed on an image bearing member (electro-photographic photosensitive member), and a development unit (developing unit) disposed on a process cartridge is included. The process cartridge is configured in such a manner that an image bearing member and a processing unit such as a developing unit acting on the image bearing member are integrally formed into a cartridge, and this cartridge is detachably disposed on a main body (apparatus main body) of the image forming apparatus.

2. Description of the Related Art

Conventionally, in the image forming apparatus employing electro-photographic image forming processing, a photosensitive drum uniformly charged by a charging device is selectively irradiated with light such as laser light, LED light, or lamplight corresponding to image information. With this, an electrostatic latent image is formed on the photosensitive drum. Then, this electrostatic latent image is developed by the developing device (developing unit). Further, a developed image formed on the photosensitive drum is transferred to a recording medium, thereby forming an image on the recording medium.

The developing device includes a developing roller for supplying developer to the photosensitive drum, a developing chamber provided with a developer supply roller for supplying the developer to the developing roller, and a developer containing chamber for containing the developer that is to be supplied to the developing chamber.

There is provided a developing device in which a developer containing chamber is arranged on the lower side of the developing chamber. In such a case, developer has to be supplied upward in the anti-gravitational direction to the developing chamber from the developer containing chamber. Therefore, a developer conveyance member for drawing and conveying developer to supply the developer from the developer containing chamber to the developing chamber is disposed within the developer containing chamber.

Then, the developer supplied to the developing chamber is gradually used in the course of image forming processing. However, there may be a case where the developer stagnates on the bottom of the developing chamber at a rear side or a corner portion of the developing chamber. This stagnated developer may remain unused until the last moment.

Therefore, in order to stir and supply the developer in a stagnant portion to the developer supply roller, a configuration in which a stirring member is disposed within the developing chamber has been discussed (Japanese Patent Application Laid-Open No. 2011-39554). A configuration of a process cartridge including a stirring member discussed in Japanese Patent Application Laid-Open No. 2011-39554 is illustrated in FIG. 15.

In the configuration illustrated in FIG. 15, developer is conveyed by a conveyance member 236 from a developer containing chamber 231*a* to a developing chamber 231*b* where a developing roller 225 is disposed. A stirring member 260 is disposed in the developing chamber 231*b*, and by the stirring member 260 being driven, the developer conveyed to the developing chamber 231*b* is moved toward a developer supply roller 234 so as to be borne by the developer supply roller 234. Further, the developer is supplied from the developer supply roller 234 to the developing roller 225, thereby developing an electrostatic latent image formed on a photosensitive drum 201.

However, if such a stirring member discussed in Japanese Patent Application Laid-Open No. 2011-39554 is disposed, this may result in increase in number of components and assembling man-hours. Further, as for a position to which the stirring member cannot reach, the developer cannot be stirred, and thus there is a possibility that stagnation of the developer will not be suppressed.

SUMMARY OF THE INVENTION

The present invention is directed to providing a simple configuration capable of suppressing stagnation of developer within the developing chamber in a developing device configured to supply developer from a developer containing chamber located on the lower side of a developing chamber to the developing chamber located on the upper side thereof.

According to an aspect of a typical configuration of the present invention, a developing device used for an image forming apparatus includes a developing roller configured to bear developer, a developer supply roller configured to supply the developer to the developing roller, a developer regulating member configured to regulate an amount of the developer borne by the developing roller, a developing chamber in which the developing roller and the developer supply roller are arranged, a developer containing chamber configured to contain the developer, located on the lower side of the developing chamber in a mounted state in which the developing device is mounted on a main body of the image forming apparatus, a partition wall configured to separate the developing chamber and the developer containing chamber, an opening configured to allow the developing chamber and the developer containing chamber to communicate with each other, disposed on the partition wall, a developer conveyance member configured to convey the developer to the developing chamber from the developer containing chamber by causing the developer to pass through the opening, disposed on the developer containing chamber, and a convex portion configured to protrude to the developing chamber, disposed in the partition wall.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A developing device and a process cartridge including the developing device according to a first exemplary embodiment of the present invention will be described below with reference to FIGS. 1 through 8.

1. Configuration of Electro-Photographic Image Forming Apparatus

Figure 2:
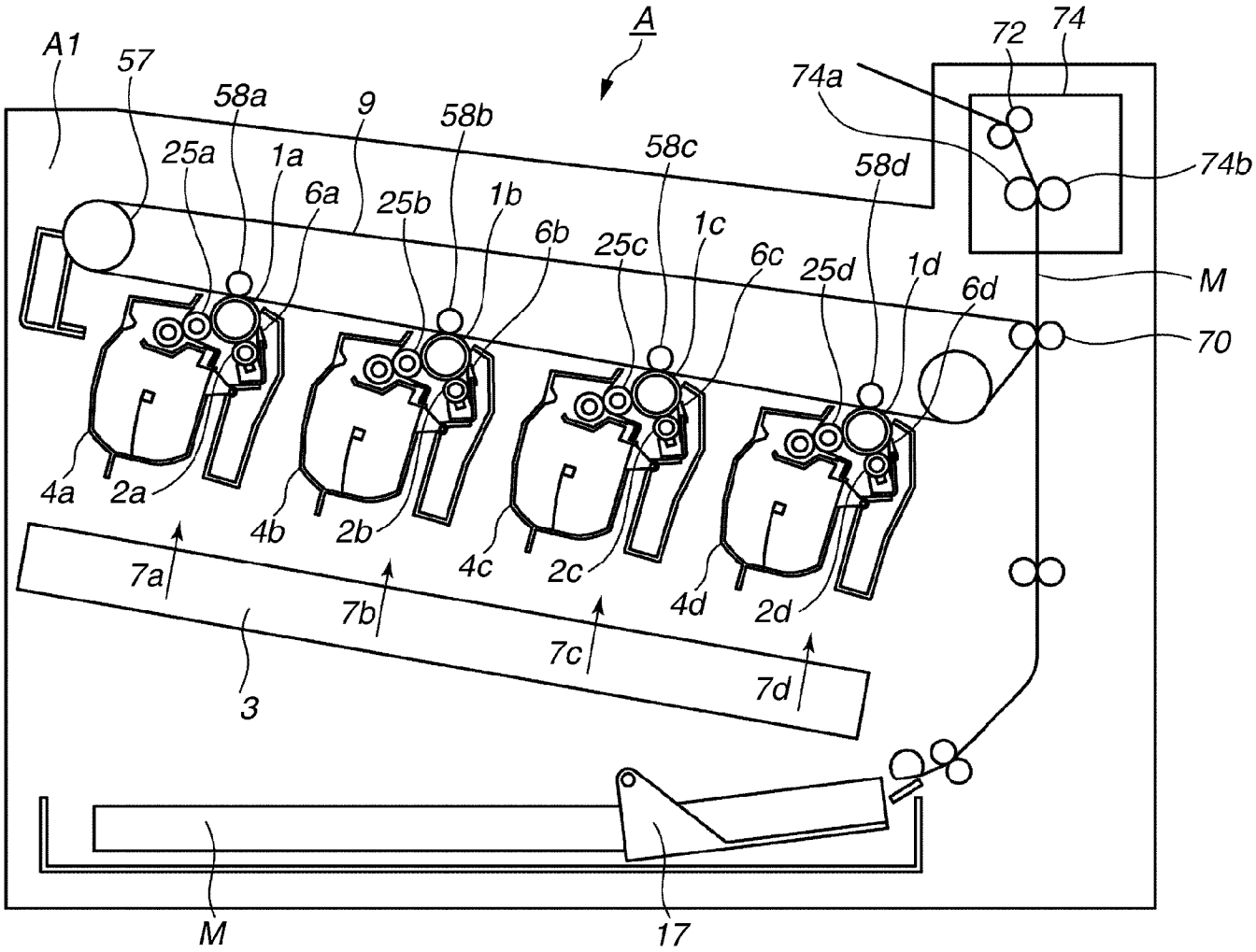
FIG. 2 is a diagram illustrating a configuration of an electro-photographic image forming apparatus according to the first exemplary embodiment.

As illustrated in FIG. 2, an image forming apparatus A includes four photosensitive drums 1 (1*a*, 1*b*, 1*c*, and 1*d*) as image bearing members which are arranged side-by-side in a slanted orientation in the horizontal direction. The photosensitive drums 1 are rotationally driven in the clockwise direction in FIG. 2 by a driving unit (not illustrated). A charging device 2, a scanner unit 3, a developing unit 4, an electrostatic transfer device 58, and a cleaning member 6 are arranged in the periphery of each of the photosensitive drums 1 in that order according to the rotational direction thereof. The charging devices 2 (2*a*, 2*b*, 2*c*, and 2*d*) are arranged on the outer circumferences of the photosensitive drums 1 as image bearing members, so as to uniformly charge photosensitive layers.

Each of the charging devices 2 is a conductive roller as a primary charging unit formed in a roll shape. This conductive roller is brought into contact with each of the photosensitive drums 1, and a charging bias voltage is applied to the conductive roller to uniformly charge a surface of each of the photosensitive drums 1.

The scanner unit 3 as a latent image forming unit irradiates a laser beam based on the image information, so as to form electrostatic latent images on the photosensitive drums 1. In other words, by using a laser diode (not illustrated), for example, the scanner unit 3 causes charged surfaces of the photosensitive drums 1 to be selectively exposed to image light of a laser beam corresponding to an image signal to form electrostatic latent images thereon. The scanner unit 3 which serves as the latent image forming unit for forming electrostatic latent images on the charged surfaces of the photosensitive drums 1 is disposed on the lower side of the photosensitive drums 1 in the gravitational direction. The developing units 4 (4*a*, 4*b*, 4*c*, and 4*d*) make developer supplied to developing rollers 25 (25*a*, 25*b*, 25*c*, and 25*d*) adhere to the electrostatic latent images on the surfaces of the photosensitive drums 1, thereby developing visible images therefrom.

The electrostatic transfer device 58 transfers the developed images on the photosensitive drums 1 to a recording medium M. The cleaning members 6 (6*a*, 6*b*, 6*c*, and 6*d*) remove transfer residual developer remains on the surfaces of the photosensitive drums 1 after transfer. In FIG. 2, the electrostatic transfer device 58 is illustrated as an intermediate transfer unit which includes an intermediate transfer member and an associated housing.

The above described photosensitive drums 1 as image bearing members, the charging devices 2 as charging units, the developing units 4, and the cleaning members 6 are integrally formed into cartridges to configure process cartridges 7 (7*a*, 7*b*, 7*c*, and 7*d*). The process cartridges 7 are configured so as to be detachable to an apparatus main body A1 of the image forming apparatus A. The apparatus main body A1 is a portion where the process cartridges 7 are excluded from the image forming apparatus A.

On the electrostatic transfer device 58, an intermediate transfer belt 9 that moves in a circular manner while facing and making contact with all of the photosensitive drums 1*a*, 1*b*, 1*c*, and 1*d* is arranged. The developer on the photosensitive drums 1*a*, 1*b*, 1*c*, and 1*d* is primarily transferred to the intermediate transfer belt 9 sequentially. The developer that is transferred to the intermediate transfer belt 9 moves counterclockwise in FIG. 2 in a circular manner, and is transferred to the recording medium M by a secondary transfer roller 70. Four primary transfer rollers 58 (58*a*, 58*b*, 58*c*, and 58*d*) make contact with an inner surface of the intermediate transfer belt 9, and are arranged side by side on the locations opposite to the four photosensitive drums 1*a*, 1*b*, 1*c*, and 1*d* respectively. Bias with a positive polarity is applied to each of the primary transfer rollers 58 at the time of transfer, and an electric charge with a positive polarity is applied to the intermediate transfer belt 9. Owing to the electrical field generated at this moment, the developed images with negative polarities formed on the photosensitive drums 1 are transferred onto the intermediate transfer belt 9 which makes contact with the photosensitive drums 1.

A plurality of recording media Ms is stored in a paper feeding cassette 17. Each of the recording media Ms within the paper feeding cassette 17 is separated and fed one-by-one, so as to be conveyed to the secondary transfer roller 70. A fixing unit 74 is configured of a rotating heating roller 74*a* and a pressure roller 74*b* that pressure-contacts with the heating roller 74*a* to apply heat and pressure onto the recording medium M. When the recording medium M onto which the developed images on the photosensitive drums 1 are transferred passes through the fixing unit 74, the pressure roller 74*b* conveys the recording medium M while the heating roller 74*a* applies heat and pressure to the recording medium M. Through this, the developed image in a plurality of colors is fixed on the surface of the recording medium M. The heating roller 74*a* and the pressure roller 74*b* are fixing units for fixing the developed image on the recording medium M. After the developed image is thermally fixed on the recording medium M in the fixing unit 74, the recording medium M is discharged to the outside of the main unit by a paper discharge roller 72.

2. Configuration of Process Cartridge

Figure 1:
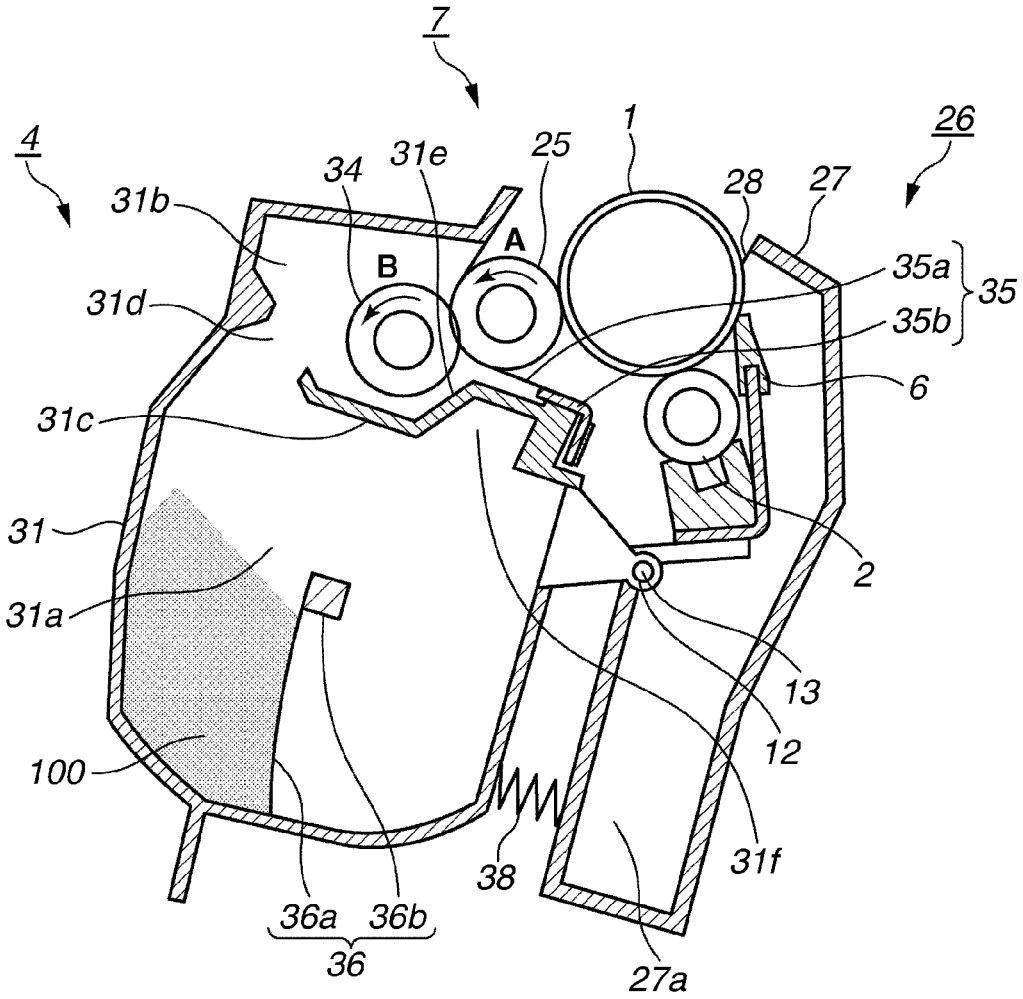
FIG. 1 is a diagram illustrating a main cross-sectional view of a process cartridge according to a first exemplary embodiment.
Figure 3:
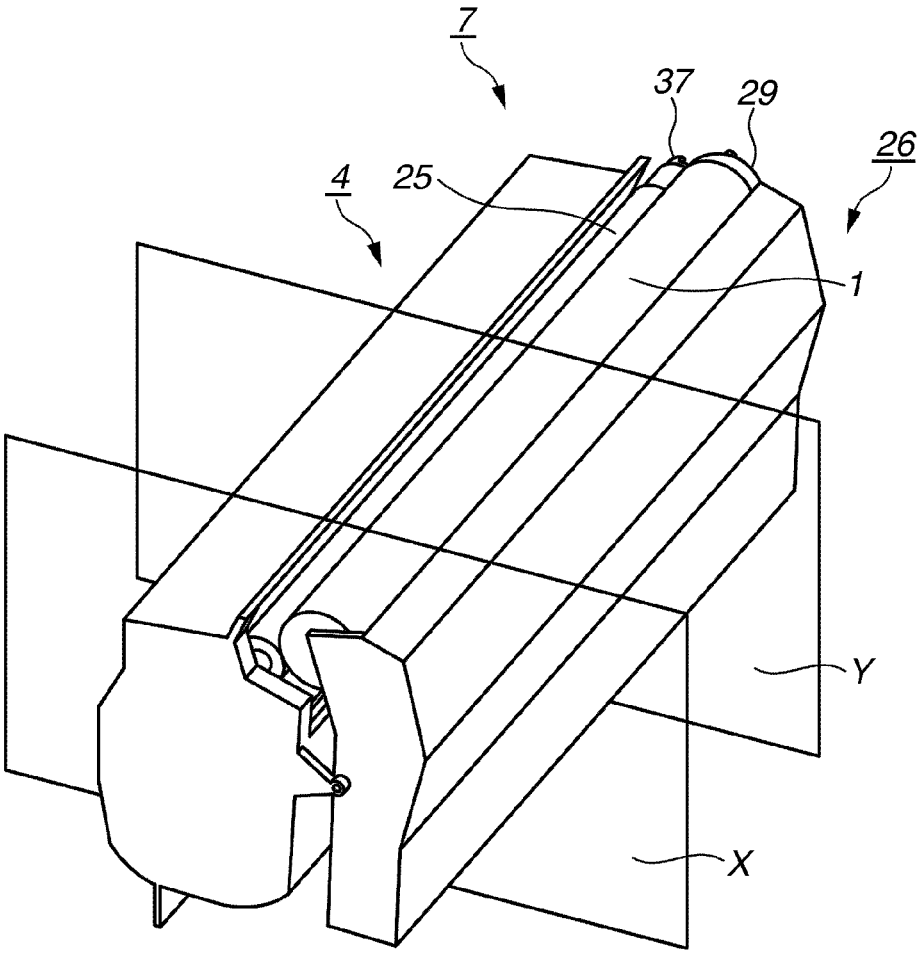
FIG. 3 is a diagram illustrating an external view of the process cartridge according to the first exemplary embodiment.

Next, the process cartridge according to the exemplary embodiment of the present invention will be described with reference to FIGS. 3 and 1. FIG. 3 is an external view of the process cartridge 7. Further, FIG. 1 is a diagram illustrating a main cross-sectional view of the process cartridge 7. In other words, FIG. 1 is a cross-sectional view taken along a plane X orthogonal to the photosensitive drum 1 (see, FIG. 3). Further, the configurations of the process cartridge 7*a* containing yellow developer, the process cartridge 7*b* containing magenta developer, the process cartridge 7*c* containing cyan developer, and the process cartridge 7*d* containing black developer are the same. Therefore, these process cartridges 7*a*, 7*b*, 7*c*, and 7*d* will be collectively described as "process cartridge 7".

The process cartridge 7 is placed in the orientation illustrated in FIG. 1 when the process cartridge 7 is mounted on the apparatus main body A1 of the image forming apparatus A (a mounted state). In the descriptions of the process cartridge 7 below, unless otherwise specified, expressions such as "upper portion", "lower portion", "upper side", and "lower side" indicate the up-down positional relationship in the mounted state (state illustrated in FIG. 1) in which the process cartridge 7 is mounted on the apparatus main body A1.

As illustrated in FIG. 3, the process cartridge 7 is configured in such a manner that a drum unit 26 including the photosensitive drum 1 and the developing unit 4 including a developing unit such as the developing roller 25 are connected to each other in a rotatable manner. A drum drive input unit 29 and a developing drive input unit 37 are provided with the drum unit 26 and the developing unit 4 respectively, so as to be capable of driving respective units by receiving a driving force from the apparatus main body A1 of the image forming apparatus A. The drum unit 26 and the developing unit 4 will be described below in detail with reference to FIG. 1.

In the drum unit 26, the charging device 2 as a primary charging unit, and a flexible sheet member 28 for preventing leakage of transfer residual developer, a waste developer, from a space between the photosensitive drum 1 and a cleaning frame member 27 are disposed on a circumference of the photosensitive drum 1. Further, the cleaning member 6 for removing the waste developer remaining on the surface of the photosensitive drum 1 is disposed on the drum unit 26. The waste developer removed from the surface of the photosensitive drum 1 by the cleaning member 6 is contained in a waste developer chamber 27*a* disposed on the cleaning frame member 27.

A container support structure of the developing unit 4 is configured so that the developing unit 4 is supported in a rotatable manner with respect to the drum unit 26. Specifically, coupling holes 12 disposed on both ends of the developing unit 4 and supporting holes 13 disposed on both ends of the cleaning frame member 27 of the drum unit 26 are aligned with each other, and pin-shaped members are inserted from both ends of the drum unit 26. Further, the developing unit 4 is continuously biased by a pressure spring 38 so as to rotate about the supporting hole 13, so that the developing roller 25 makes contact with the photosensitive drum 1.

The developing unit 4 is provided with a developer containing chamber 31*a* and a developing chamber 31*b* which are configured of a developing frame member 31. The developing frame member 31 may be configured of a plurality of frame members. In the orientation at the time of image formation, the developer containing chamber 31*a* is disposed and positioned on the lower side of the developing chamber 31*b* in the gravitational direction, and the developer containing chamber 31*a* and the developing chamber 31*b* are separated by a partition wall 31*c* that is a part of the developing frame member 31. The developer containing chamber 31*a* contains the toner 100 as developer, and a developer conveyance member 36 for conveying the toner 100 to the developing chamber 31*b* is disposed therein. The developer conveyance member 36 is configured of a conveyance sheet 36*a* and a conveyance member rotation shaft 36*b*. On the upper portion of the developer containing chamber 31*a*, in order to supply developer to the developing chamber 31*b*, an opening 31*d* which communicates the developing chamber 31*b* and the developer containing chamber 31*a* is disposed on the partition wall 31*c*. The developing roller 25 which rotates in a direction indicated by an arrow A with making contact with the photosensitive drum 1, and a developer supply roller 34 which rotates in a direction indicated by an arrow B with making contact with the developing roller 25 are arranged on the developing chamber 31*b*. Further, a developing blade unit 35 as a developer regulating member which makes the developer on the developing roller 25 be a thin layer with making contact with the developing roller 25 is arranged on the developing chamber 31*b*. The developing blade unit 35 is configured of a developing blade 35*a* which practically abuts on the developing roller 25, and a base member 35*b* configured of a plate that supports the developing blade 35*a*. The rotation direction of the developer supply roller 34 may be a direction opposite to the direction indicated by the arrow B.

Next, the processing starting from supplying the toner 100 to developing an electrostatic latent image will be described. First, the developer conveyance member 36 rotates about the conveyance member rotation shaft 36*b* as a rotary axis, and the conveyance sheet 36*a* conveys the toner 100 from the developer containing chamber 31*a* to the developing chamber 31*b* through the opening 31*d*. The toner 100 conveyed to the developing chamber 31*b* is applied to the developing roller 25 by the developer supply roller 34. According to the rotation of the developing roller 25, the toner 100 applied on the developing roller 25 is regulated to have a predetermined layer thickness by the developing blade 35*a*, and conveyed to a developing portion where the photosensitive drum 1 and the developing roller 25 are opposed to each other. In the developing portion, the toner 100 on the developing roller 25 is caused to adhere to an electrostatic latent image formed on the surface of the photosensitive drum 1 by developing bias applied from a power source (not illustrated). Through this, the electrostatic latent image is developed to a visible image. Then, the toner 100 remaining on the surface of the developing roller 25 which did not contribute to the development of the electrostatic latent image is brought back according to the rotation of the developing roller 25 and collected into the developing chamber 31*b*.

3. Configuration of Developing Chamber

Figure 4:
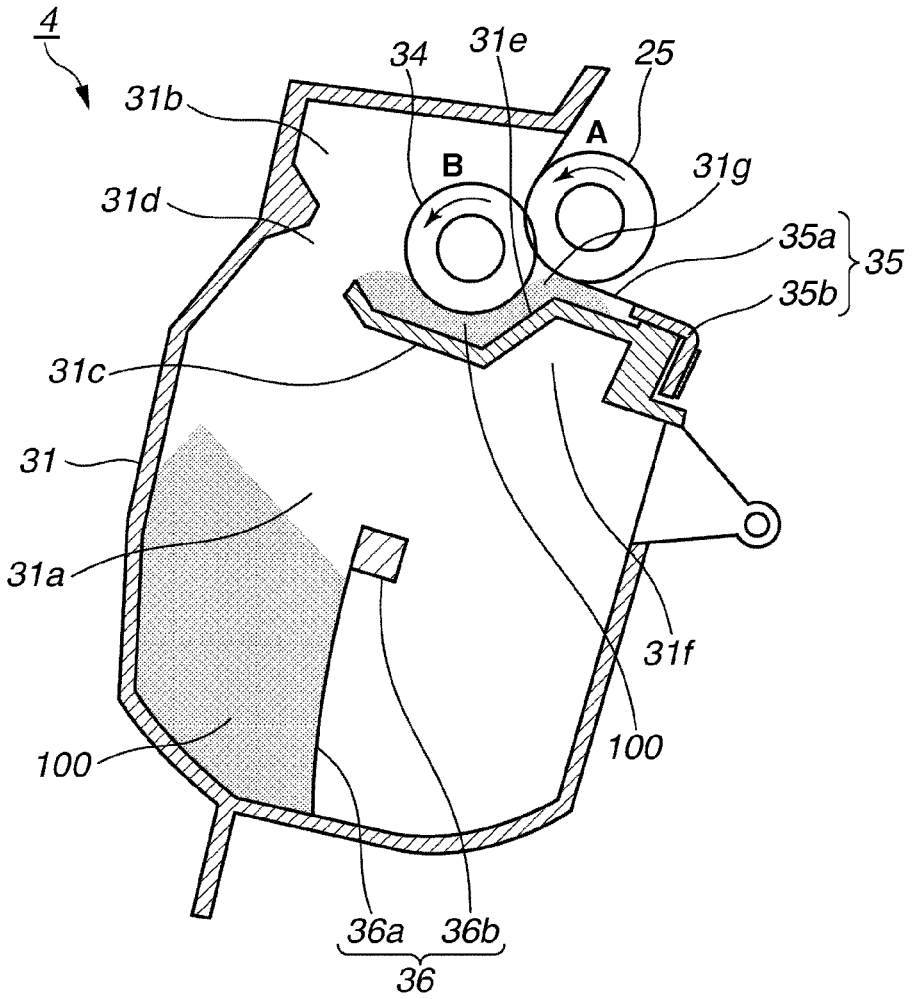
FIG. 4 is a diagram illustrating configurations of a developing chamber and a developer containing chamber according to the first exemplary embodiment.

Next, a configuration of the developing chamber 31*b* will be described with reference to FIG. 4. FIG. 4 is a diagram illustrating a cross-sectional view of the developing unit 4 taken along a position of the plane X in FIG. 3. The toner 100 supplied to the developing chamber 31*b* from the opening 31*d* gradually moves toward the rear portion of the developing chamber 31*b* by free fall by the gravity or being pushed by other toner 100 supplied afterward. As described above, in the image forming processing, the toner 100 is applied to the developing roller 25 by the developer supply roller 34 and consumed gradually. However, the toner 100 positioned away from the developer supply roller 34 may be difficult to be consumed. Furthermore, the developer which is scraped off from the developing roller 25 by the developing blade 35*a* exists on the periphery of the developing blade 35*a*. As a result, the position on the rear side of the developing chamber 31*b*, surrounded by the developer supply roller 34 and the developing blade 35*a*, is a position where the conveyed developer and the scraped developer easily stagnate. Hereinafter, such a position is referred to as a stagnant portion 31*g*. The toner 100 stagnating in the stagnant portion 31*g* will remain within the developing chamber 31*b* without being used until the last moment to become residual developer. There is tendency that the larger the capacity of the stagnant portion 31*g*, the greater the volume of residual developer.

As a method for improving the above problem, as illustrated in FIG. 4, on the developing chamber 31*b*, a developing chamber embedding portion 31*e* is disposed on a position surrounded by the developer supply roller 34, the developing blade 35*a* and the partition wall 31*c*, which is the rear side of the developing chamber 31*b* when seen from the opening 31*d*. The developing chamber embedding portion 31*e* is a convex portion formed by causing a part of the partition wall 31*c* to be protruded toward the developing chamber 31*b*. With this, the capacity of the stagnant portion 31*g*, that is a position in the developing chamber 31*b* where the toner 100 easily stagnates, can be smaller, so that the amount of residual developer can be reduced.

As described above, in general, a volume of residual developer stagnates in the position surrounded by the developer supply roller 34, the developing blade 35*a*, and the partition wall 31*c*, and thus such a position may easily become the stagnant portion 31*g*. Therefore, it is effective to arrange the developing chamber embedding portion 31*e* on the position surrounded by the developer supply roller 34, the developing blade 35*a*, and the partition wall 31*c*.

Further, an arrangement of the developing chamber embedding portion 31*e* will be described in detail with reference to FIG. 10. As described above, the toner 100 positioned away from the developer supply roller 34 is difficult to be consumed to easily become residual developer. From among the regions surrounded by the developer supply roller 34, the developing blade 35*a*, and the partition wall 31*c*, in particular, the toner 100 easily stagnates and remain in a region on the lower side of the developing roller 25 and the developing blade 35*a*, located further posterior to the developer supply roller 34 in the developing chamber 31*b*. Therefore, in the present exemplary embodiment, the developing chamber embedding portion 31*e* is arranged on a position which overlaps with the developing roller 25 and the developing blade unit 35 when seen in the gravitational direction G (at a line of sight parallel to the gravitational direction G). With this, the toner 100 positioned on the lower portion of the developing roller 25 and the developing blade unit 35 can be prevented from remaining.

Further, of the toner 100 positioned on the lower side of the developer supply roller 34, the toner 100 positioned on the bottom side of the developing chamber 31*b* tends to remain because this toner 100 is difficult to be collected by the developer supply roller 34 when compared to the toner 100 positioned in the vicinity of the developer supply roller 34. Therefore, the developing chamber embedding portion 31*e* is arranged on the position which also overlaps with the developer supply roller 34 when seen in the gravitational direction G. This enables the toner 100 positioned on the bottom side of the developing chamber 31*b* to be easily collected by the developer supply roller 34.

Furthermore, in the present exemplary embodiment, an area in the developing chamber embedding portion 31*e* indicated by an arrow E is an inclined surface 31*e*1, and this inclined surface 31*e*1 inclines upward as approaching the developing roller 25 from the lower side of the developer supply roller 34. The developer supply roller 34 rotates so that the surface thereof facing to the partition wall 31*c* and the developing chamber embedding portion 31*e* moves in a direction approaching the developing roller 25, in other words, in a direction indicated by an arrow B1. Through the rotation thereof, the toner 100 positioned on the bottom side of the developing chamber 31*b* easily moves toward the developing roller 25 along the inclined surface 31*e*1.

Accordingly, in the present exemplary embodiment, the region L allocated for the developing chamber embedding portion 31*e* is configured to at least partially overlap with each of the developer supply roller 34, the developing roller 25, and the developing blade unit 35, when seen in the gravitational direction G. Obviously, the configuration thereof is not limited to the above, and the toner 100 can be effectively prevented from remaining as long as the developing chamber embedding portion 31*e* is positioned on a location where the developing chamber embedding portion 31*e* at least partially overlaps with any of the developer supply roller 34, the developing roller 25, and the developing blade unit 35.

In addition, the developing chamber embedding portion 31*e* may be disposed on a position on the front side of the developer supply roller 34 in the developing chamber 31*b*, close to the opening 31*d*. For example, the developing chamber embedding portion 31*e* may be disposed on immediately near a position entering the developing chamber 31*b* through the opening 31*d*. Since such a position is away from the developer supply roller 34, it is difficult for the developer supply roller 34 to collect the toner 100. Therefore, it is possible that residual developer is generated therein, and the position may easily be a stagnant portion of the developer. Accordingly, providing the developing chamber embedding portion 31*e* in this position is effective in reducing the amount of residual developer.

Figure 5:
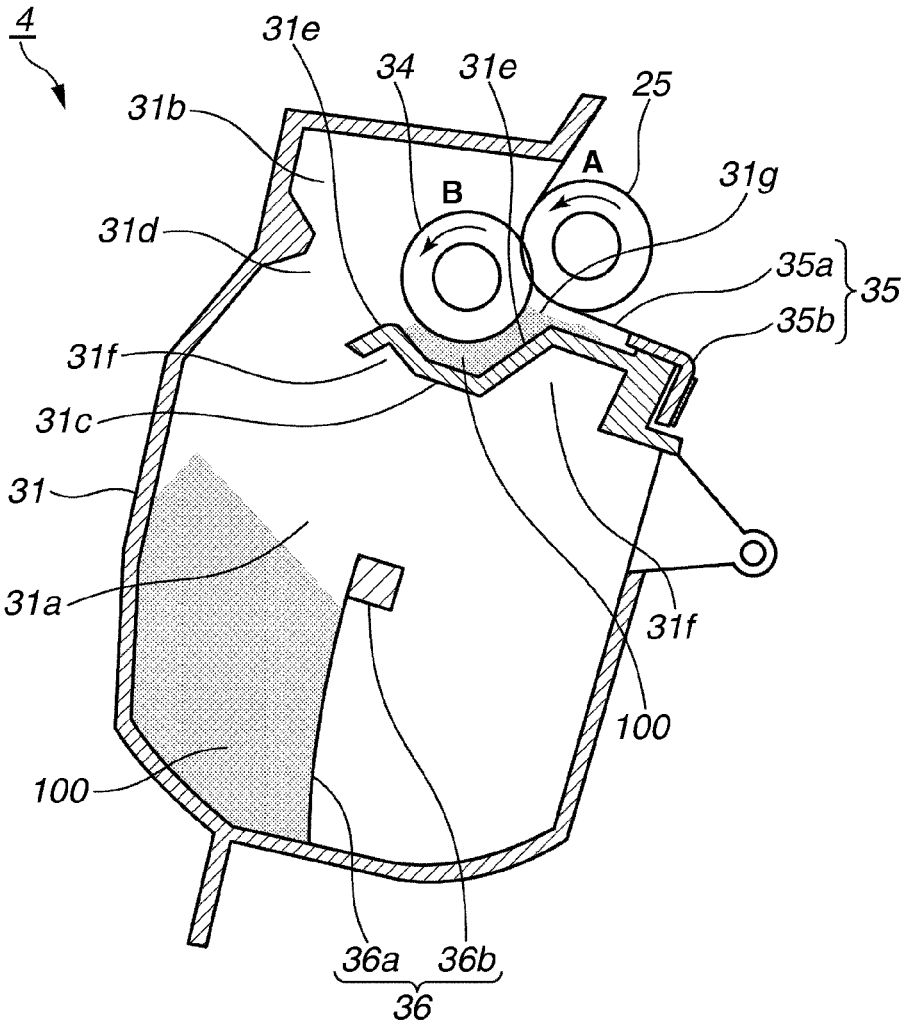
FIG. 5 is a diagram illustrating a second configuration of the developing chamber according to the first exemplary embodiment.

As one example of the above-described configuration, a variation of the present exemplary embodiment in which the developing chamber embedding portions 31*e* are disposed on two places, the rear side and the entrance side of the developing chamber 31*b*, is illustrated in FIG. 5. In other words, in the variation illustrated in FIG. 5, a plurality of the developing chamber embedding portions 31*e* (in this variation, two developing chamber embedding portions 31*e*) is arranged side by side along the depth direction of the developing chamber 31*b* when the developing chamber 31*b* is seen from the opening 31*d*.

Further, the developing chamber embedding portion 31*e* is formed of a concave shape when seen from the developer containing chamber 31*a*. The functions thereof will be described below in "Configuration of Developer Containing Chamber".

4. Configuration of Developer Containing Chamber

A configuration of a concave shape of the developing chamber embedding portion 31*e* in the developer containing chamber 31*a* will be described with reference to FIG. 4. As illustrated in FIG. 4, a concave portion 31*f* is disposed on the upper portion of the developer containing chamber 31*a* corresponding to a protruded position of the developing chamber embedding portion 31*e*. In the orientation at the time of image formation, the lower side of the concave portion 31*f* in the gravitational direction is opened, so that the toner 100 positioned within the concave portion 31*f* freely falls into the developer containing chamber 31*a* at the time of the image formation. The toner 100 that has fallen into the developer containing chamber 31*a* is also used for image forming processing as in a same manner as the other toner 100 contained in the developer containing chamber 31*a*.

Figure 6:
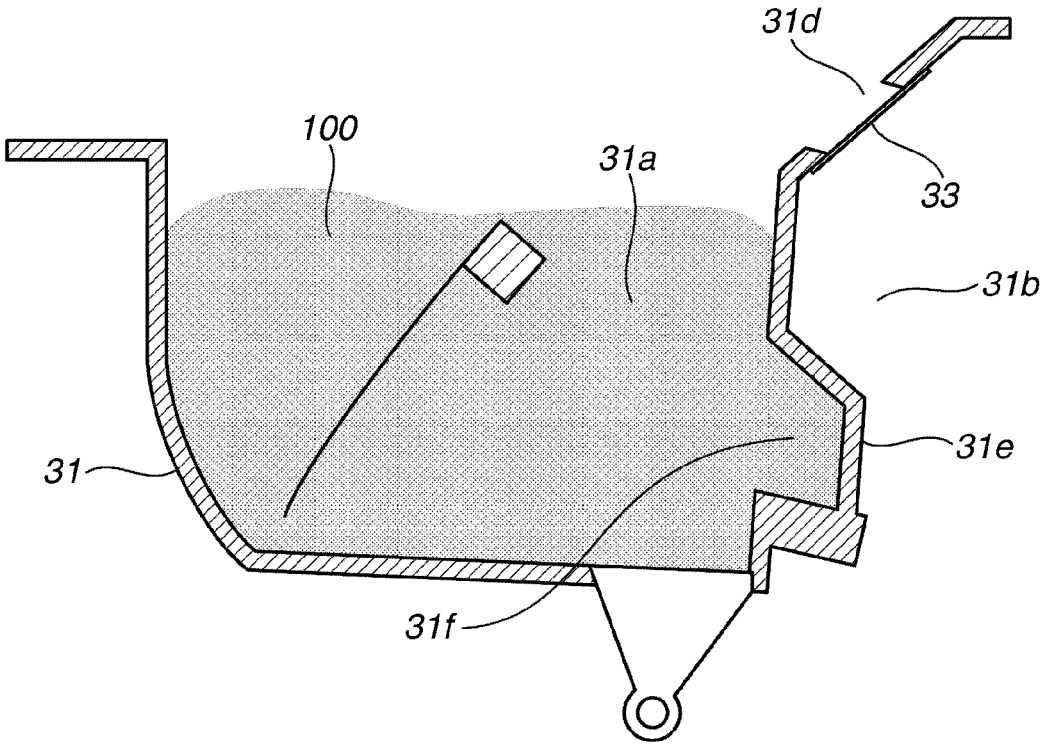
FIG. 6 is a diagram illustrating an orientation where a developing unit according to the first exemplary embodiment is filled with developer.

Next, functions of the concave portion 31*f* at the time of manufacturing at which the developer containing chamber 31*a* is filled with developer will be described with reference to FIG. 6. As illustrated in FIG. 6, when the developer containing chamber 31*a* is filled with the toner 100, in many cases, the developing unit 4 is placed in the orientation where the developer containing chamber 31*a* and the developing chamber 31*b* are positioned side by side in the lateral direction. At this time, the opening 31*d* is sealed with a sealing member 33 that will be removed therefrom when the cartridge is to be used.

As described in the above "Configuration of Process Cartridge", in the present exemplary embodiment, the developing frame member 31 is assumed to be formed of a plurality of frame members. Therefore, as illustrated in FIG. 6, the developer containing chamber 31*a* is filled with the toner 100 in a state in which a part of the frame members is removed. Furthermore, although it is not illustrated in the drawings, as another example of the fill-up orientation, there is provided a method in which the developing unit 4 is placed in the orientation in which the lengthwise direction thereof (the direction of a rotational axis of the developing roller 25) is set to be a vertical direction, and the developer containing chamber 31*a* is filled up from a lengthwise side surface.

By filling with the toner 100 in the above described orientations, the interior portion of the concave portion 31*f* can be also filled up with the toner 100 because the entrance side of the concave portion 31*f* faces in the direction other than the lower side in the gravitational direction. As a result, the interior portion of the concave portion 31*f* can be used as a part of the developer containing chamber 31*a*, and thus a filling amount of the toner 100 can be increased without increasing the size of the developing unit 4.

5. Developer Regulating Member

Next, the developing blade unit 35 will be described with reference to FIGS. 7, 8, and 11.

First, a configuration for fixing the developing blade unit 35 on the developing unit 4 will be described with reference to FIGS. 7 and 11. FIG. 7 is an external view of the developing unit 4 illustrating a state where the developing blade unit 35 is mounted on the developing frame member 31. FIG. 11 is an external view illustrating a state before the developing blade unit 35 is mounted on the developing frame member 31.

Figure 11:
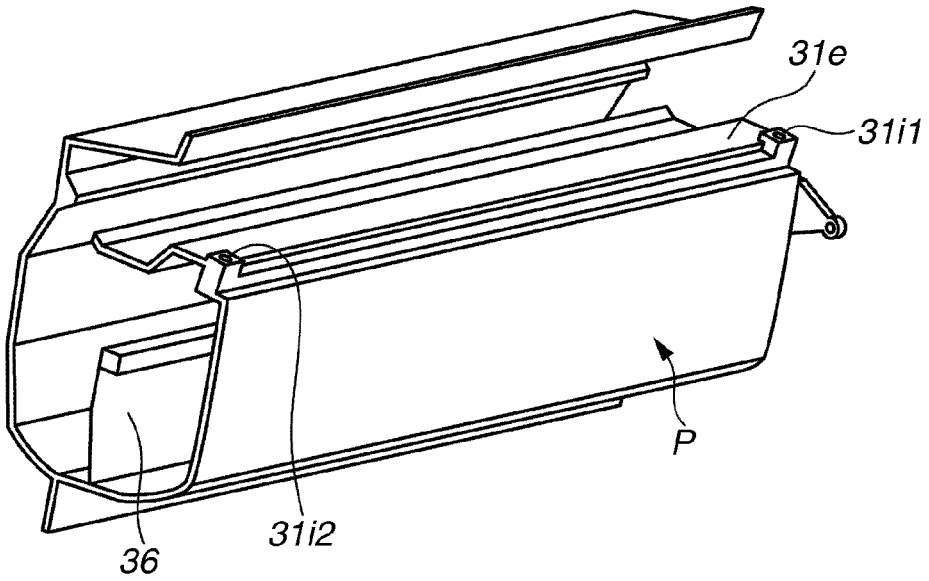
FIG. 11 is a diagram illustrating a fixing portion for fixing a developing blade unit according to the first exemplary embodiment.

As illustrated in FIG. 11, the developing frame member 31 is provided with support bearing surfaces 31*i*1 and 31*i*2 as a first fixing portion and a second fixing portion for fixing the developing blade unit 35. A base member 35*b* is attached to the support bearing surfaces 31*i*1 and 31*i*2, so that the developing blade unit 35 is fixed to the developing frame member 31. Specifically, after the base member 35*b* is placed on the support bearing surfaces 31*i*1 and 31*i*2, as illustrated in FIG. 7, the base member 35*b* is fixed by fastening units 40. In the present exemplary embodiment, each of the fastening units 40 is a screw which passes through a hole provided in the base member 35*b* to fit with a hole provided in each of the support bearing surfaces 31*i*1 and 31*i*2. In this manner, the developing blade unit 35 is fixed to the developing unit 4.

Next, a sealing configuration for filling a space between the base member 35*b* to which the developing blade 35*a* is attached and the developing frame member 31 will be described with reference to FIGS. 7 and 8.

Figure 7:
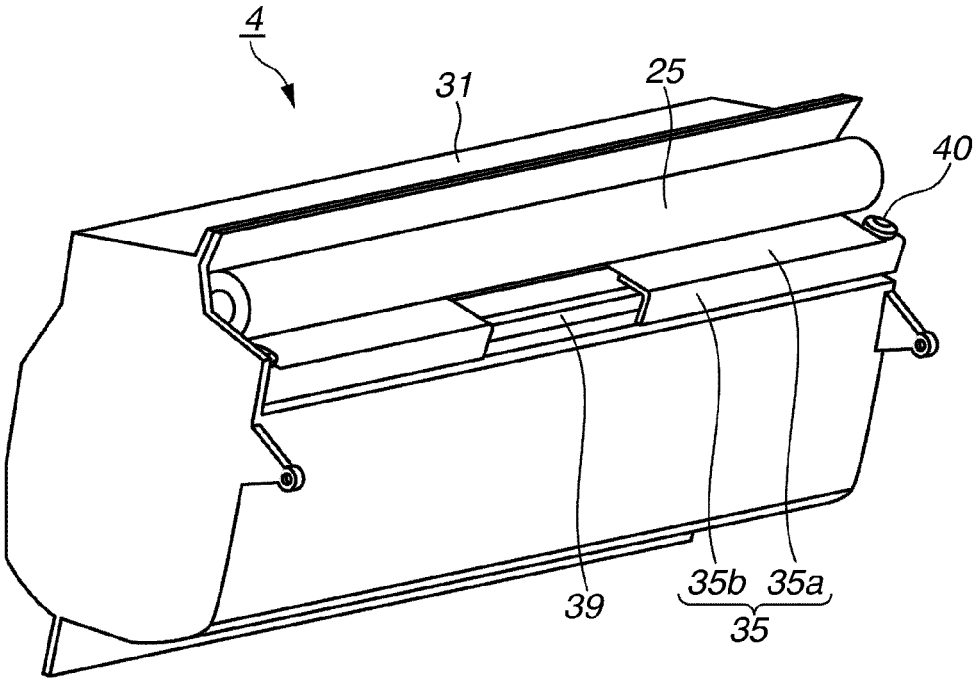
FIG. 7 is an external view illustrating a sealing configuration between a base member and a developing frame member according to the first exemplary embodiment.

In order to describe the sealing configuration disposed on the back side of the developing blade unit 35, FIG. 7 illustrates a state where the central portion in the lengthwise direction of the developing blade unit 35 is cut off. Further, FIG. 8 is a cross-sectional view of the developing unit 4 taken along a position of a plane Y in FIG. 3, which illustrates a cross-sectional view further to the center in the lengthwise direction when compared to the cross-sectional view of FIG. 4. First, as illustrated in FIG. 7, an elastic seal member 39 is disposed between the base member 35*b* and the developing frame member 31 in the lengthwise direction to seal the toner 100 within the developing chamber 31*b*. The base member 35*b* compresses the elastic seal member 39 into a predetermined thickness, and is attached to the developing frame member 31 by the above described fastening units 40. The elastic seal member 39 is a sealing member for sealing a space between the developing frame member 31 and the base member 35*b* to restrict leakage of the toner 100 from the space between the developing frame member 31 and the base member 35*b*.

Figure 8:
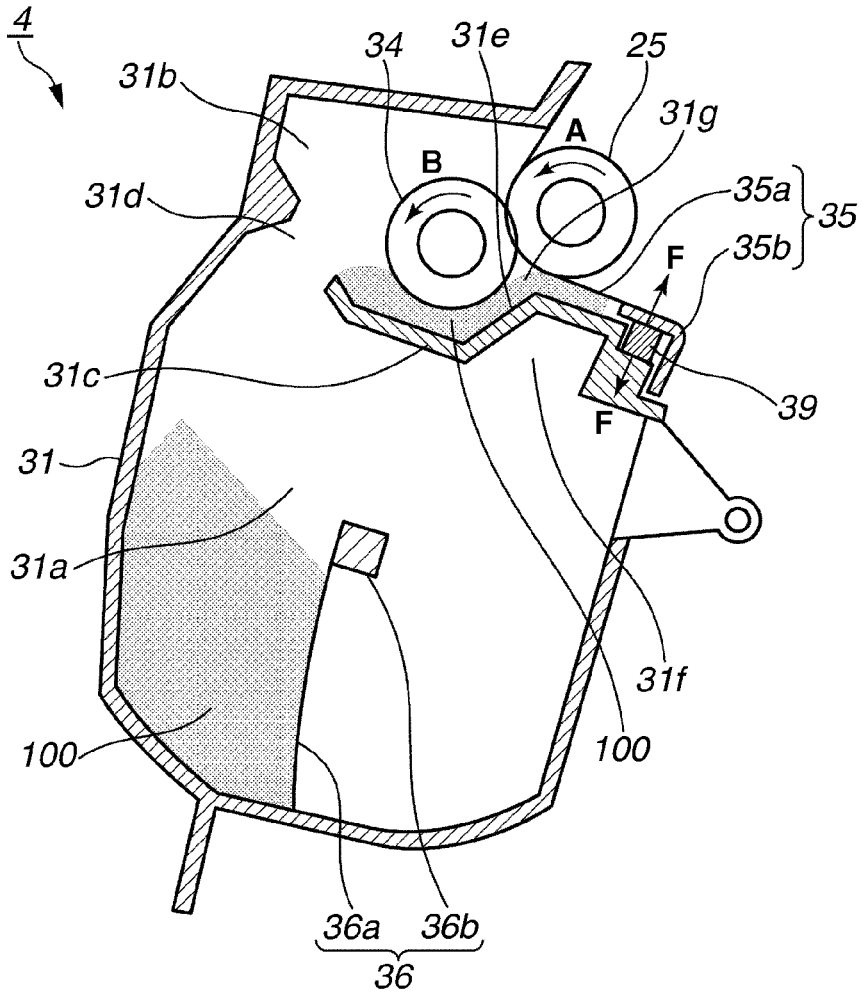
FIG. 8 is a diagram illustrating a sealing configuration between the base member and the developing frame member according to the first exemplary embodiment.

At this time, as illustrated in FIG. 8, the base member 35*b* and the developing frame member 31 are held in a state in which a repulsive force F from the elastic seal member 39 is respectively applied thereto. In general, when the repulsive force F from the elastic seal member 39 is large, there is a possibility that the developing frame member 31 is deformed due to the repulsive force F. In such a case, a positional relationship and inclinations of the developing frame member 31 and the base member 35 change to cause a setting relationship between the developing blade 35*a* and the developing roller 25 to change. Therefore, the developing frame member 31 having high rigidity in the periphery of the base member 35*b* can stabilize the setting relationship between the developing blade 35*a* and the developing roller 25. In addition, regardless of presence or absence of the elastic seal member 39, deformation is less in the developing frame member 31 with higher rigidity, and thus the setting relationship between the developing blade 35*a* and the developing roller 25 can be further stabilized. In the present exemplary embodiment, the developing chamber embedding portion 31*e* is a concavo-convex shape portion disposed in the vicinity of the developing blade 35*a*. Therefore, rigidity of the developing frame member 31 in the periphery of the base member 35*b* is increased. Through this, deformation of the developing frame member 31 due to the repulsive force F can be reduced, and the positional relationship between the developing blade 35*a* and the developing roller 25 can be stabilized. Accordingly, the developing blade 35*a* can stably regulate the amount of developer borne by the developing roller 25.

As illustrated in FIG. 11, in the present exemplary embodiment, at least a part of the developing chamber embedding portion 31*e* is positioned between the support bearing surface 31*i*1 and the support bearing surface 31*i*2 in the direction of the rotational axis of the developing roller 25. In other words, when viewing in a direction P that is orthogonal to the direction of the rotational axis of the developing roller 25, at least a part of the developing chamber embedding portion 31*e* is arranged in a position between the support bearing surface 31*i*1 and the support bearing surface 31*i*2. Since the rigidity of the developing frame member 31 is higher in the area between the two fixing portions for fixing the developing blade unit 35, the position of the developing blade unit 35 can be further stably held.

6. Entry Restriction Portion

Figure 12:
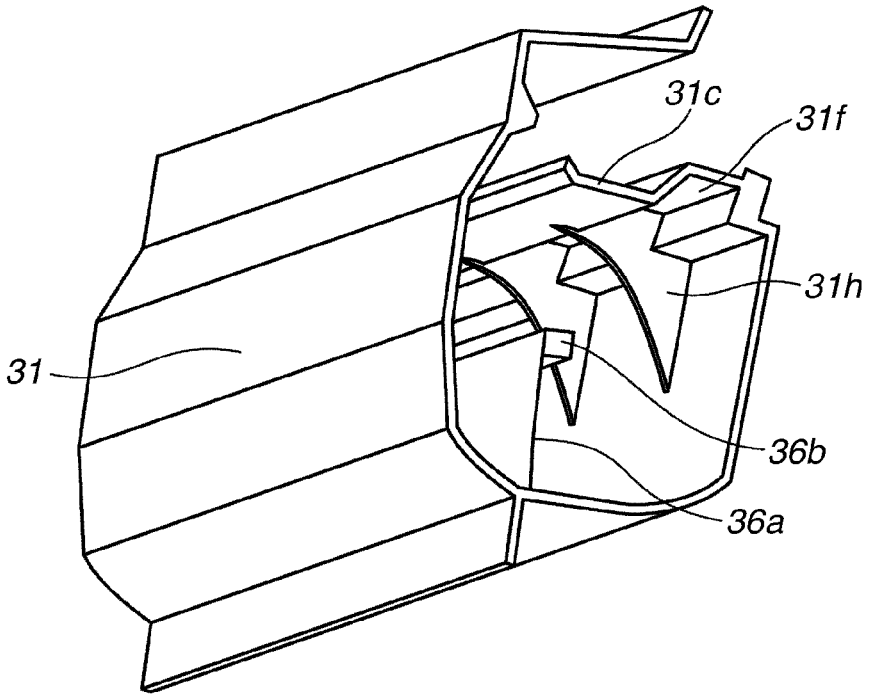
FIG. 12 is a diagram illustrating an entry restriction portion according to the first exemplary embodiment.

Next, an entry restriction portion 31*h* for restricting entry of the developer conveyance member 36 to the concave portion 31*f* will be described with reference to FIGS. 10 and 12. FIG. 12 is a cross-sectional view of the developing frame member 31 illustrating the entry restriction portion 31*h*.

Figure 10:
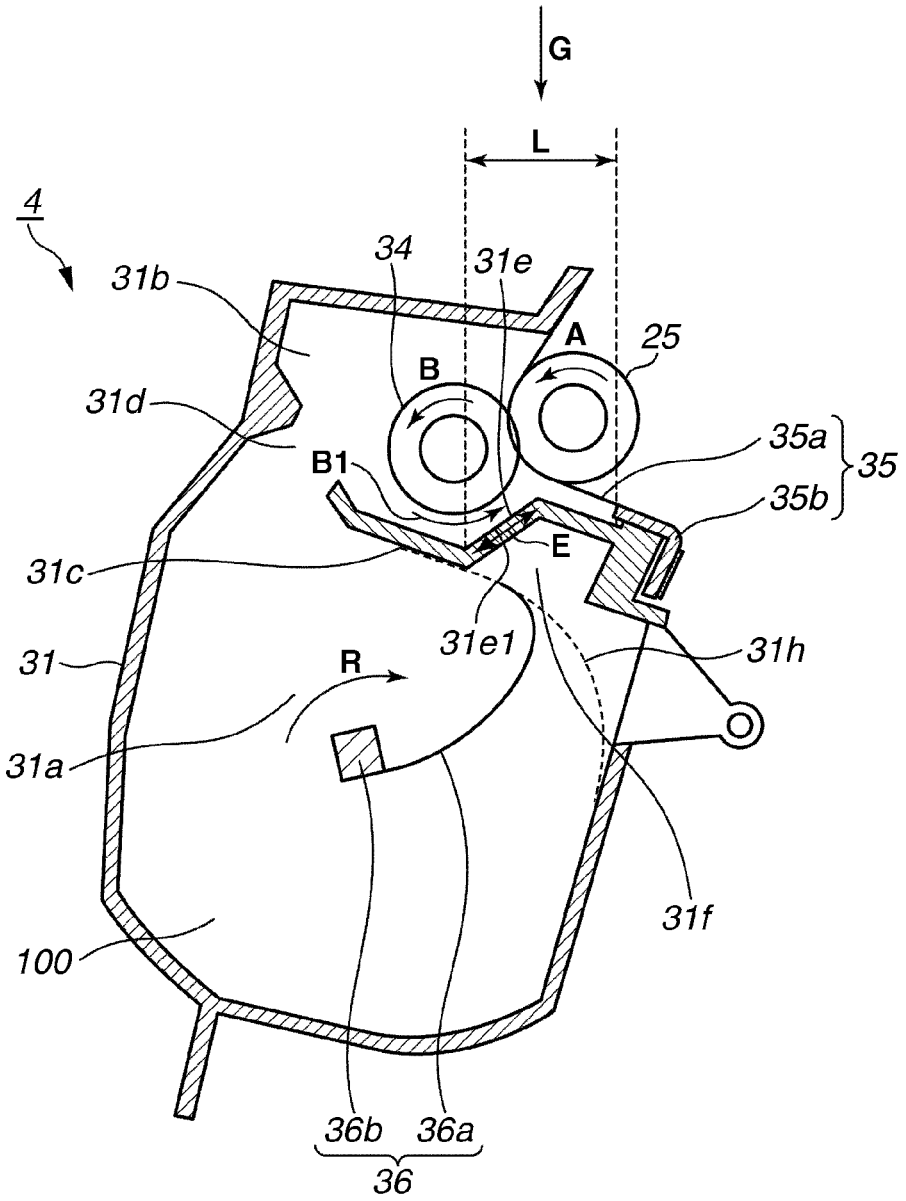
FIG. 10 is a diagram illustrating an arrangement of the developing chamber embedding portion according to the first exemplary embodiment.

The developer conveyance member 36 rotates in a direction indicated by an arrow R illustrated in FIG. 10. The maximum radius of the developer conveyance member 36 is set to be greater than the distance between the partition wall 31*c* and the conveyance member rotation shaft 36*b*. Since the conveyance sheet 36*a* of the developer conveyance member 36 is formed of a sheet-like member having flexibility and elasticity, the conveyance sheet 36*a* rotates in a deformed state when the conveyance sheet 36*a* makes contact with the partition wall 31*c*.

As described above, a concave portion 31*f* is formed on the partition wall 31*c* caused by the developing chamber embedding portion 31*e* (see, FIG. 1). When the leading end of the conveyance sheet 36*a* enters the concave portion 31*f*, there may be a case where deformation that is generated when the conveyance sheet 36*a* makes contact with the partition wall 31*c* is cleared abruptly due to own elasticity of the developer conveyance member 36. At this time, there is a possibility that the conveyance sheet 36*a* makes a noise by hitting against the inner wall of the developer containing chamber 31*a* due to an excess force that is generated when the conveyance sheet 36*a* clears its own deformation.

Furthermore, if the conveyance sheet 36*a* clears the deformation at the concave portion 31*f*, the excess force generated therefrom may cause the toner 100 carried by the conveyance sheet 36*a* to scatter. At this moment, because the toner 100 scatters within the developer containing chamber 31*a*, a developer remaining amount measurement unit (not illustrated) disposed on the apparatus main body A1 cannot precisely measure the remaining amount of the toner 100 within the developer containing chamber 31*a*.

Therefore, according to an aspect of the present exemplary embodiment, as illustrated in FIG. 12, in order to prevent the leading end of the conveyance sheet 36*a* from entering the concave portion 31*f*, the entry restriction portion 31*h* is disposed on the developing frame member 31. As illustrated in FIG. 12, the entry restriction portion 31*h* includes a curved portion which connects the partition wall 31*c* and the inner wall of the developer containing chamber 31*b*, so that the entry restriction portion 31*h* makes contact with the conveyance sheet 36*a* to restrict entry of the leading end of the conveyance sheet 36*a* to the concave portion 31*f*. Therefore, the conveyance sheet 36*a* rotates while making contact with the entry restriction portion 31*h* not to enter the concave portion 31*f*.

With this, deformation of the conveyance sheet 36*a* is prevented from being cleared at the concave portion 31*f*. As a result, the conveyance sheet 36*a* can be prevented from making a noise at the concave portion 31*f*. In addition, the conveyance sheet 36*a* can be prevented from scattering the toner 100 at the concave portion 31*f*.

As described above, according to the present exemplary embodiment, by providing the developing chamber embedding portion 31*e*, the position in the developing chamber 31*b* where the toner 100 stagnates can be filled, and the toner 100 is prevented from stagnating without adding a new component. This enables the amount of residual developer to be reduced.

Further, with respect to a space that is conventionally a part of the developing chamber 31*b* where the toner 100 has stagnated, the concave portion 31*f* is provided on the side of the developer containing chamber 31*a*, so that the space can be used as a part of the developer containing chamber 31*a*. In other words, the space that has been problematic in terms of stagnation of the toner 100 can be effectively utilized as a filling space of the toner 100. Further, rigidity of the developing frame member 31 can be increased by the developing chamber embedding portion 31*e*. Therefore, an alignment relationship of the developing blade 35*a* and the developing roller 25 can be more stabilized than in a conventional art.

Figure 9:
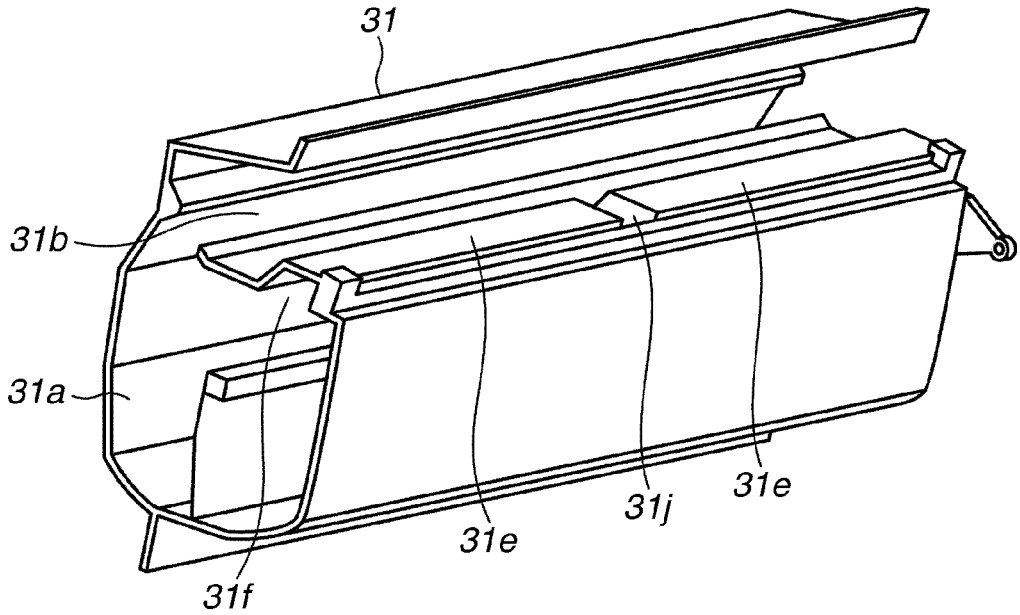
FIG. 9 is a diagram illustrating a configuration of a developing chamber embedding portion according to a second exemplary embodiment.

A second exemplary embodiment of the developing device and the process cartridge including the developing device according to the present invention will be described below with reference to FIG. 9. Configurations other than the configuration of the developing chamber embedding portion 31*e* are the same as those in the first exemplary embodiment, and thus the descriptions thereof will be omitted.

2-1. Configuration of Developing Chamber Embedding Portion

A configuration of the developing chamber embedding portion 31*e* according to the present exemplary embodiment will be described with reference to FIG. 9. A basic configuration of the developing chamber embedding portion 31*e* is similar to that in the first exemplary embodiment. As illustrated in FIG. 9, the developing chamber embedding portion 31*e* is configured of two regions divided in the lengthwise direction (the direction of the rotational axis of the developing roller 25) of the developing unit 4 while molding performance of the developing frame member 31 is taken into consideration. Due to the shape and the alignment, there is a high possibility that the developing chamber embedding portion 31*e* becomes an undercut with respect to a main mold configuration for molding the developing frame member 31. Therefore, it is assumed that the developing chamber embedding portion 31*e* is formed by a slide mechanism associated with the main mold configuration. Generally, in a slide mechanism of the mold, the slide mechanism tends to be difficult to move smoothly when a slide width thereof becomes wider. Since in a case of the molds having a same thickness, a resin pressure during a molding period causes the mold to deform easily as a width of the mold is wider. Therefore, as illustrated in FIG. 9, the developing chamber embedding portion 31*e* is divided into two portions in the lengthwise direction. This enables the slide mechanism to be divided into two portions to make the width of each slide mechanism shorter. With this, stability of the molding and maintenance characteristics of the mold can be improved. In addition, in the present exemplary embodiment, the developing chamber embedding portion 31*e* is divided into two portions in the lengthwise direction (the direction of the rotational axis of the developing roller 25). However, the developing chamber embedding portion 31*e* may be divided into three or more portions so as to be configured of a plurality of portions.

Figure 13:
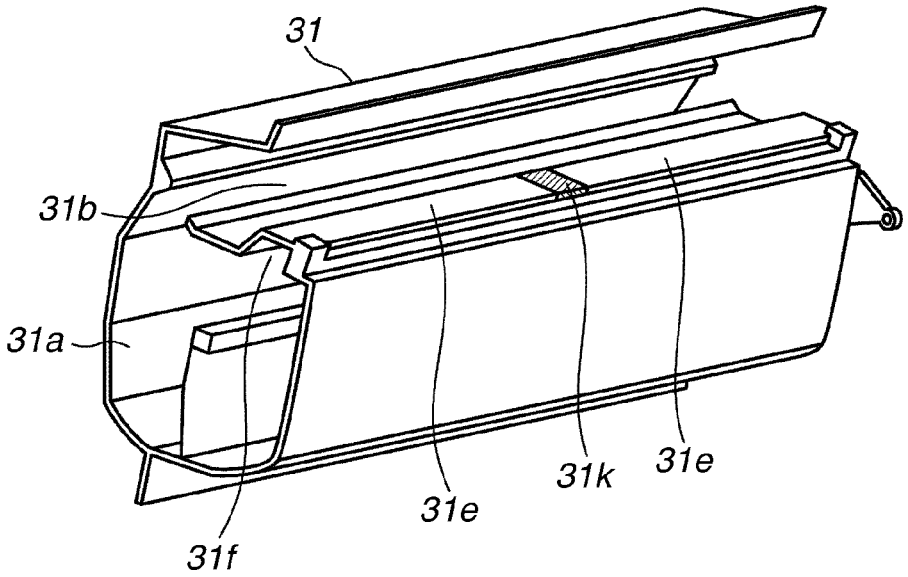
FIG. 13 is a diagram illustrating an embedding member according to the second exemplary embodiment.

Further, in the present exemplary embodiment, from among a plurality of the developing chamber embedding portions 31*e* arranged side by side along the direction of the axis line of the developing roller 25, a groove portion 31*j*, a groove like space created by dividing the developing chamber embedding portion 31*e* into two portions, is formed on a space between two developing chamber embedding portions 31*e* that are adjacent to each other. The elastic seal member 39 (see, FIG. 3) for filling the space between the developing blade 35*a* and the developing frame member 31 described in the first exemplary embodiment may be extended to fill in the groove portion 31*j*, so that stagnation of the toner 100 can be further improved. Furthermore, as illustrated in FIG. 13, an embedding member 31*k* may be separately disposed to fill in the groove portion 31*j*.

As described above, according to the present exemplary embodiment, the molding performance of the developing frame member 31 and the maintenance characteristics of the mold can be improved.

A third exemplary embodiment will be described. A configuration in which the rotational direction of the developer supply roller 34 is set to be a direction opposite to the direction of the first and the second exemplary embodiments will be described below as another exemplary embodiment.

Figure 14:
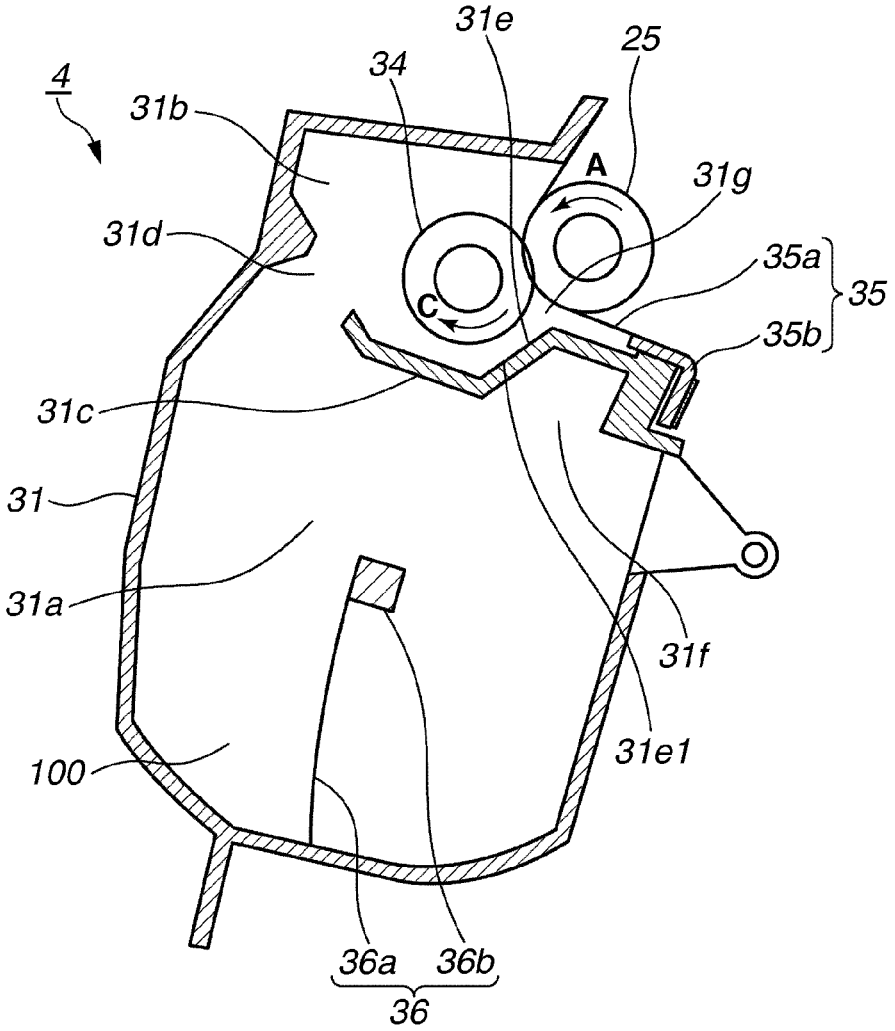
FIG. 14 is a diagram illustrating a developing device according to a third exemplary embodiment.
Figure 15:
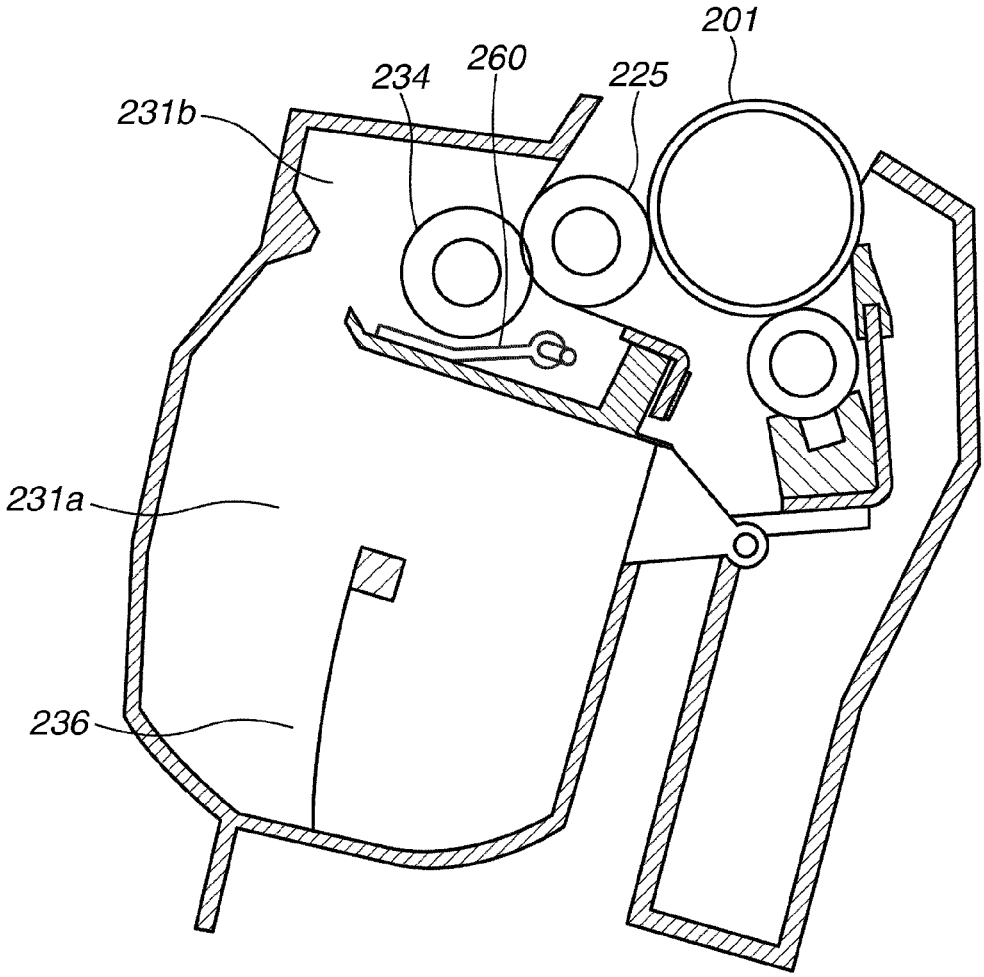
FIG. 15 is a diagram illustrating a conventional example described in Japanese Patent Application Laid-Open No. 2011-39554.

In the present exemplary embodiment, as illustrated in FIG. 14, the developer supply roller 34 rotates in a direction indicated by an allow C. In other words, the developer supply roller 34 rotates in a direction where the surface thereof facing the partition wall 31*c* and the developing chamber embedding portion 31*e* approaches the opening 31*d*. Through the rotation thereof, the developer supply roller 34 causes the toner 100 in the vicinity of the developing chamber embedding portion 31*e* to move along the inclined surface 31*e*1 toward the opening 31*d*, and thus the toner 100 can be prevented from remaining in the periphery of the developing chamber embedding portion 31*e*.

Overview

As described above, according to the present invention, in the developing device configured to supply developer from the developer containing chamber located on the lower side of the developing chamber to the developing chamber located on the upper side thereof, a position in the developing chamber where the developer stagnates is filled without adding a new component, so that the developer can be prevented from stagnating. Through this, it is possible to provide a developing device and a process cartridge capable of reducing the amount of residual developer, increasing the capacity of a developer containing chamber, increasing the rigidity of a developing frame member, and stabilizing the alignment relationship between a developing blade and a developing roller more than in a conventional art.

As described thus far, according to the present invention, in the developing device configured to supply developer from the developer containing chamber located on the lower side of the developing chamber to the developing chamber located on the upper side thereof, the developer can be prevented from stagnating with a simple configuration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-111885 filed May 15, 2012, which is hereby incorporated by reference herein in its entirety.

What is claimed is:

1. A developing device used for an image forming apparatus comprising:

a developing roller configured to bear developer;

a developer supply roller configured to supply the developer to the developing roller;

a developer regulating member configured to regulate an amount of the developer borne by the developing roller;

a developing chamber in which the developing roller and the developer supply roller are arranged;

a developer containing chamber configured to contain the developer, located on a lower side of the developing chamber in a mounted state where the developing device is mounted on a main body of the image forming apparatus;

a partition wall configured to separate the developing chamber and the developer containing chamber;

an opening configured to allow the developing chamber and the developer containing chamber to communicate with each other, disposed on the partition wall;

a developer conveyance member configured to convey the developer from the developer containing chamber to the developing chamber by causing the developer to pass through the opening, disposed in the developer containing chamber; and a convex portion configured to protrude to the developing chamber side, disposed on the partition wall and in a side of the partition opposite to a side of the partition which is near the opening, wherein the convex portion is concaved from the developer containing chamber side, so as to form a concave portion in the developer containing chamber.

2. The developing device according to claim 1 further comprising:

a first fixing portion configured to fix the developer regulating member; and a second fixing portion configured to fix the developer regulating member at a position different from a position of the first fixing portion, wherein at least a part of the convex portion is positioned between the first fixing portion and the second fixing portion in a direction of a rotational axis of the developing roller.

3. The developing device according to claim 1, wherein the developer supply roller rotates in a direction where a surface facing the partition wall approaches the opening.

4. The developing device according to claim 1, wherein the developer supply roller rotates in a direction where a surface facing the partition wall approaches the developing roller.

5. The developing device according to claim 1, wherein when seen along a gravitational direction in the mounted state, the convex portion is positioned on a location where the convex portion at least partially overlaps with at least any of the developer regulating member, the developing roller, and the developer supply roller.

6. The developing device according to claim 1, wherein the convex portion includes an inclined surface that inclines upward as approaching the developing roller from the lower side of the developer supply roller in the mounted state.

7. The developing device according to claim 1, further comprising an entry restriction portion configured to restrict entry of the developer conveyance member to the concave portion by making contact with the developer conveyance member.

8. The developing device according to claim 1, wherein the developing device includes a plurality of the convex portions.

9. The developing device according to claim 8, wherein, when the developing chamber is seen from the opening, the plurality of the convex portions is arranged side by side along the depth direction of the developing chamber.

10. The developing device according to claim 8, wherein the plurality of the convex portions is arranged side by side along a direction of a rotational axis of the developing roller.

11. The developing device according to claim 10, wherein, in the developing chamber, a space sandwiched between two adjacent convex portions from among the plurality of the convex portions is formed, and wherein the developing device includes an embedding member for filling the space.

12. A process cartridge detachable to an apparatus main body of an image forming apparatus, the process cartridge comprising:

a photosensitive drum on which an electrostatic latent image is formed; and the developing device according to claim 1.

13. An image forming apparatus configured to form an image on a recording medium, the image forming apparatus comprising:

a photosensitive drum on which an electrostatic latent image is formed;

a fixing unit configured to fix a developed image on the recording medium; and the developing device according to claim 1.

14. A developing device used for an image forming apparatus comprising:

a developing roller configured to bear developer;

a developer supply roller configured to supply the developer to the developing roller;

a developer regulating member configured to regulate an amount of the developer borne by the developing roller;

a developing chamber in which the developing roller and the developer supply roller are arranged;

a developer containing chamber configured to contain the developer, located on a lower side of the developing chamber in a mounted state where the developing device is mounted on a main body of the image forming apparatus;

a partition wall configured to separate the developing chamber and the developer containing chamber;

an opening configured to allow the developing chamber and the developer containing chamber to communicate with each other, disposed on the partition wall;

a developer conveyance member configured to convey the developer from the developer containing chamber to the developing chamber by causing the developer to pass through the opening, disposed in the developer containing chamber; and a plurality of the convex portions configured to protrude to the developing chamber side, disposed on the partition wall.

15. The developing device according to claim 14 further comprising:

a first fixing portion configured to fix the developer regulating member; and a second fixing portion configured to fix the developer regulating member at a position different from a position of the first fixing portion, wherein at least a part of the convex portion is positioned between the first fixing portion and the second fixing portion in a direction of a rotational axis of the developing roller.

16. The developing device according to claim 14, wherein the developer supply roller rotates in a direction where a surface facing the partition wall approaches the opening.

17. The developing device according to claim 14, wherein the developer supply roller rotates in a direction where a surface facing the partition wall approaches the developing roller.

18. The developing device according to claim 14, wherein when seen along a gravitational direction in the mounted state, the convex portion is positioned on a location where the convex portion at least partially overlaps with at least any of the developer regulating member, the developing roller, and the developer supply roller.

19. The developing device according to claim 14, wherein the convex portion includes an inclined surface that inclines upward as approaching the developing roller from the lower side of the developer supply roller in the mounted state.

20. The developing device according to claim 14, further comprising an entry restriction portion configured to restrict entry of the developer conveyance member to the concave portion by making contact with the developer conveyance member.

21. The developing device according to claim 14, wherein when the developing chamber is seen from the opening, the plurality of the convex portions is arranged side by side along the depth direction of the developing chamber.

22. The developing device according to claim 14, wherein the plurality of the convex portions is arranged side by side along a direction of a rotational axis of the developing roller.

23. The developing device according to claim 14, wherein, in the developing chamber, a space sandwiched between two adjacent convex portions from among the plurality of the convex portions is formed, and wherein the developing device includes an embedding member for filling the space.

24. A process cartridge detachable to an apparatus main body of an image forming apparatus, the process cartridge comprising:

a photosensitive drum on which an electrostatic latent image is formed; and the developing device according to claim 14.

25. An image forming apparatus configured to form an image on a recording medium, the image forming apparatus comprising:

a photosensitive drum on which an electrostatic latent image is formed;

a fixing unit configured to fix a developed image on the recording medium; and the developing device according to claim 14.

26. A developing device used for an image forming apparatus comprising:

a developing roller configured to bear developer;

a developer regulating member configured to regulate an amount of the developer borne by the developing roller;

a developing chamber in which the developing roller is arranged;

a developer containing chamber configured to contain the developer, located on a lower side of the developing chamber in a mounted state where the developing device is mounted on a main body of the image forming apparatus;

a partition wall configured to separate the developing chamber and the developer containing chamber;

an opening configured to allow the developing chamber and the developer containing chamber to communicate with each other;

a developer conveyance member configured to convey the developer from the developer containing chamber to the developing chamber by causing the developer to pass through the opening, disposed in the developer containing chamber; and a convex portion configured to protrude to the developing chamber side, disposed on the partition wall and in a side of the partition opposite to a side of the partition which is near the opening, wherein the convex portion is concaved from the developer containing chamber side, so as to form a concave portion in the developer containing chamber.

* * * * *